United States Patent [19]

Domenighetti

[11] Patent Number: 4,655,636

[45] Date of Patent: Apr. 7, 1987

[54] PNEUMATIC INTEGRAL POLYGONAL SUSPENSION FOR VIBRATING TAMPING MACHINES

[75] Inventor: Domenico Domenighetti, Lugano, Italy

[73] Assignee: SIMESA - Societa Italiana Montaggi E Servizi Affini S.p.A., Milan, Italy

[21] Appl. No.: 733,777

[22] Filed: May 14, 1985

[30] Foreign Application Priority Data

Jun. 15, 1984 [IT] Italy ..... 21449 A/84

[51] Int. Cl.[4] ..... E01C 19/28

[52] U.S. Cl. ..... 404/117; 404/122; 404/133; 152/56

[58] Field of Search ..... 404/103, 117, 122, 130, 404/133, 124; 152/56

[56] References Cited

U.S. PATENT DOCUMENTS

| | | | |
|---|---|---|---|
| 1,147,619 | 7/1915 | Dobbins | 152/56 |
| 1,147,621 | 7/1915 | Dobbins | 152/56 |
| 2,190,370 | 2/1940 | Smallwood et al. | 152/56 |
| 2,704,968 | 3/1955 | Paramythioti | 404/122 |
| 3,107,907 | 10/1963 | Barnum | 404/122 X |
| 3,108,519 | 10/1963 | Domenighetti | 404/117 |
| 3,283,678 | 11/1966 | Domenighetti | 404/117 |
| 3,323,428 | 6/1967 | Domenighetti | 404/117 |
| 3,778,177 | 12/1973 | Haker et al. | 404/103 X |
| 3,966,344 | 6/1976 | Haker et al. | 404/117 |

FOREIGN PATENT DOCUMENTS

| | | | |
|---|---|---|---|
| 866516 | 3/1971 | Canada | 404/117 |
| 1050321 | 3/1979 | Canada | 404/122 |
| 715671 | 12/1941 | Fed. Rep. of Germany | 404/122 |
| 1101776 | 10/1955 | France | 404/117 |
| 1233488 | 10/1960 | France | 404/117 |
| 593924 | 5/1959 | Italy . | |
| 595270 | 6/1959 | Italy . | |
| 364804 | 11/1962 | Switzerland . | |
| 365099 | 12/1962 | Switzerland . | |

*Primary Examiner*—Stephen J. Novosad
*Assistant Examiner*—John F. Letchford
*Attorney, Agent, or Firm*—Young & Thompson

[57] ABSTRACT

A pneumatic suspension device, suitable for transmitting torque, is composed of a single toroid-shaped vibration-damping pneumatic ring. The inner surface of the ring rests on a rim connected to the part of the machine which must be free from vibration (for example, a hydraulic engine). The machine is directly flanged on a reduction unit, and both the machine and device are made integral with a bracket and frame. The outer surface of the pneumatic ring is gripped by a series of S-shaped jaw elements, bolted onto a support ring welded to the inner cylindrical wall of a vibrating drum. The S-shaped jaw elements have a profile such that each pair of jaws, once fixed in position on the outer band of the toroidal pneumatic ring, forms therewith a single body damping the vibration of the drum.

6 Claims, 3 Drawing Figures

PNEUMATIC INTEGRAL POLYGONAL SUSPENSION FOR VIBRATING TAMPING MACHINES

It has been demonstrated in vibrating compacting rollers for road construction and in many other vibrating machines, that systems with a cushion of air for insulating from vibration those parts of machines which should be kept free from vibration are superior. The vibrating effect is instead concentrated on the ground or on other materials which are to be subjected to vibration.

Swiss Pat. No. 364804 of Aug. 25, 1958 and No. 365,099 of Aug. 28, 1958 and relative international extensions, among which are Italian Pat. No. 593.924 of Aug. 27, 1958 and No. 595.270 of Sept. 1, 1958, describe some devices of this type.

The devices for damping vibration and simultaneously transmitting rotary motion to a vibrating member, according to the prior art in this field, comprised as a basic element one or more toroid-shaped pneumatic rings, suitably fitted on generally metallic rigid elements having geometrical shapes (when fitted in position) similar to those of so-called "solids of revolution".

The present invention relates to a novel and improved pneumatic suspension device which is suitable for transmitting torque. The device makes use of a single vibration-damping pneumatic ring by means of a special structuring of the rigid elements which envelop and block the pneumatic ring 1 in position.

The accompanying drawings illustrate, by way of example, an embodiment of this invention, namely:

According to the present invention the rigid elements can be divided into two categories:

inner rigid elements and outer rigid elements.

Once fixed in position the inner rigid elements and the outer rigid elements are interconnected solely be means of the pneumatic ring in such a way that, if, for example the set of inner rigid elements is subjected to vibration, the set of outer rigid elements feels the effect thereof only through the pneumatic ring 1, which is able to dampen a large part of the vibration.

According to the present invention the inner rigid elements, indicated by 2, are still of the conventional type, whereas the outer rigid elements 3 are made in such a form that, when fixed in position, they do not take on the shape of a "solid of revolution", but rather that of a polygonal structure, which experience has shown to be especially suitable for transmitting torque.

Figure 1:
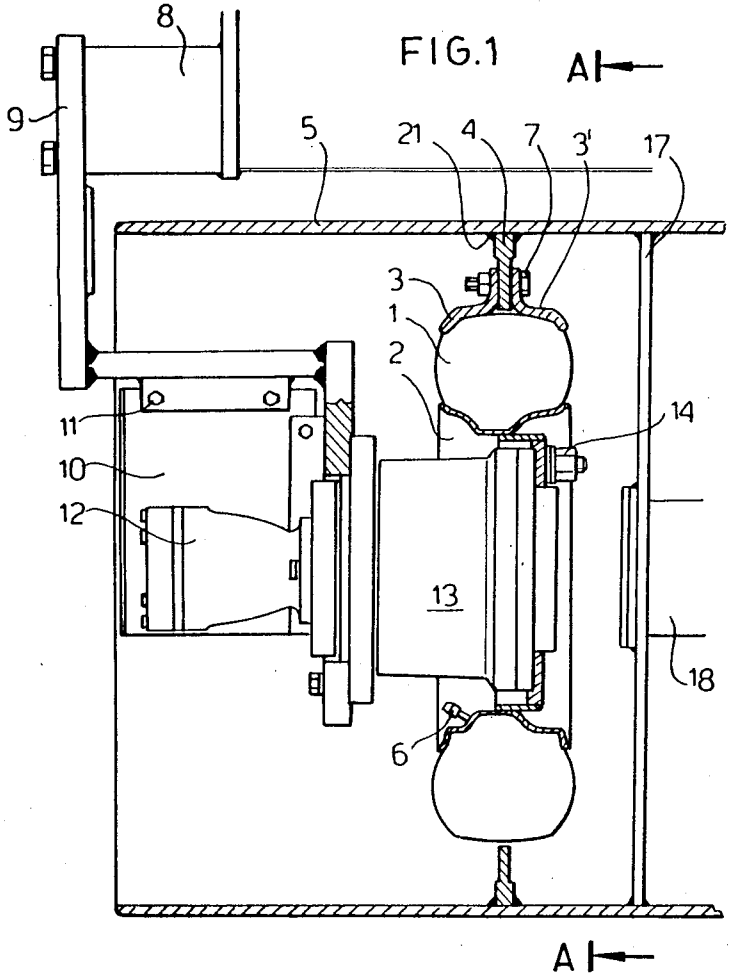
FIG. 1 is a sectional view along two planes containing an axis perpendicular to the plane in which the vibration-damping pneumatic ring is lying as indicated with (1—1) in FIG. 2.

In FIG. 1 the vibration-damping pneumatic ring is indicated by 1, the set of conventional type inner rigid elements by 2—for example, of the type commonly defined in the automobile sector by the term "rim"—and the outer or peripheral rigid elements by 3, which according to the present invention are of such a size and positioned in such a way as to take on a geometrical shape, clearly different from that defined as "solid of revolution".

The elements 3 are fixed on a generally metallic ring 4, integral with the vibrating drum 5, which acts as a tamper or compactor.

The valve 6 which allows the pressure inside the central pneumatic ring be controlled, can be seen protruding from the inner rigid element 2 (rim).

The outer rigid elements 3, 3' are fixed in pairs onto the rigid ring 4 by means of bolts 7.

As mentioned before, FIG. 1 is a sectional view of the vibrating drum 5 and some parts of the roller adjacent thereto. The view is along the sectional plane 1—1 shown in FIG. 2.

In FIG. 1 the main frame of the machine, which must be free from vibration, is indicated by 8 and the descending bracket is indicated by 9. The bracket is integral with the frame and supports the end of the vibrating drum 5. A protective covering 10 is fixed to bracket 9 by means of bolts 11. The hydraulic engine 12 is directly flanged on the reduction unit 13 and is protected by the covering from any parts projecting in from the outside.

The reduction unit 13 is fixed to bracket 9 and at the other end holds with bolts 14 the rim 2 fitter with valve 6.

A ring 4 (FIG. 1) with inner diameter greater than the outer diameter of the pneumatic ring is welded onto the vibrating drum 5.

The outer rigid elements 3, 3' are composed of two symmetrical bodies which are fixed onto the support ring 4 by means of bolts 7.

The conventional type inner rigid element 2 (rim) is fixed onto reduction unit 13 by means of bolts.

In addition, the vibrating drum is provided with an inside wall 17 which also serves to support the vibrating device (or vibrator) 18 in the center of the drum.

Figure 3:
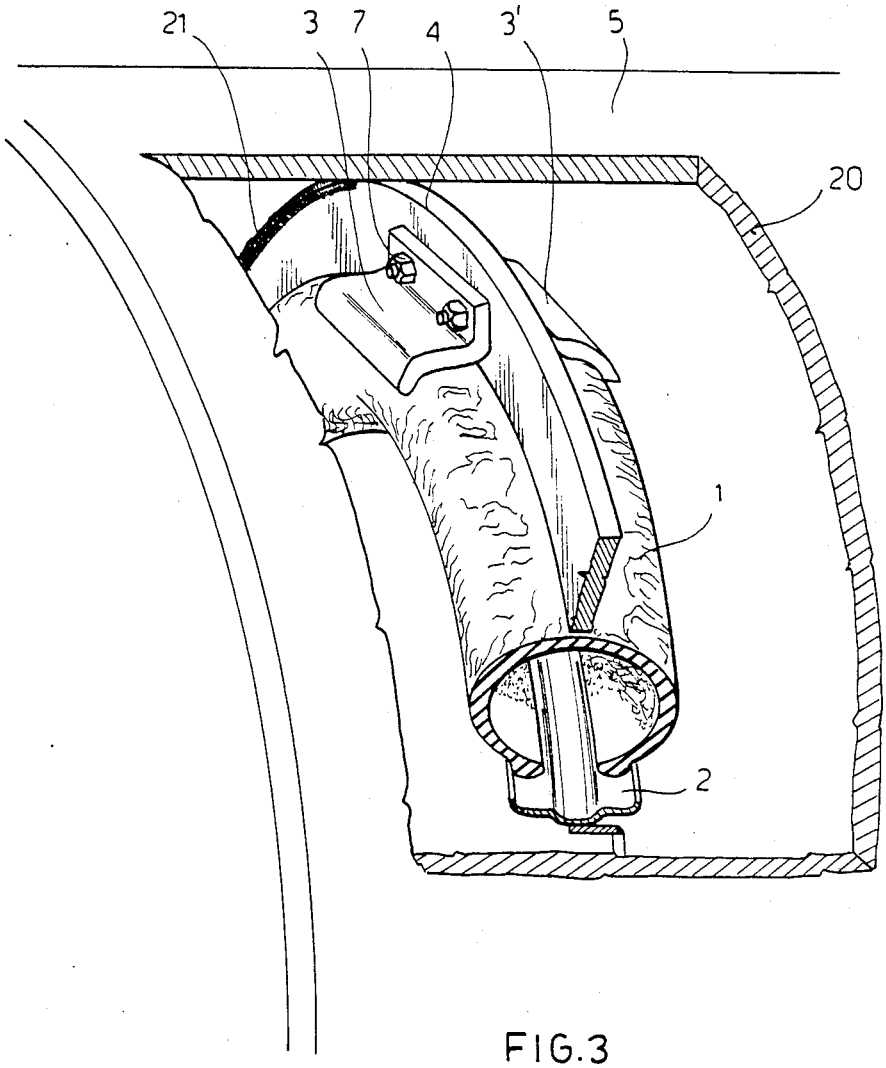
FIG. 3 shows a partial perspective view of the vibration-damping pneumatic ring.

FIG. 3 shows a partial perspective view of the vibrating drum 5, with a window 20 shown in the metallic shell in order to better illustrate one embodiment of the present invention. As shown through the window 20, in the foreground the support ring 4 is fixed to the vibrating drum 5 by welding 21. The rigid elements 3, 3' are fixed onto the ring 4 by means of bolts 7 and, when bolted on, grip the outer band of the pneumatic ring 1, while the rigid element 2 engages the inside thereof.

The other end (not shown) of drum 5 is supported by means of a pneumatic suspension system of the type described in the above-mentioned previous patents which is not part of the present invention.

Figure 2:
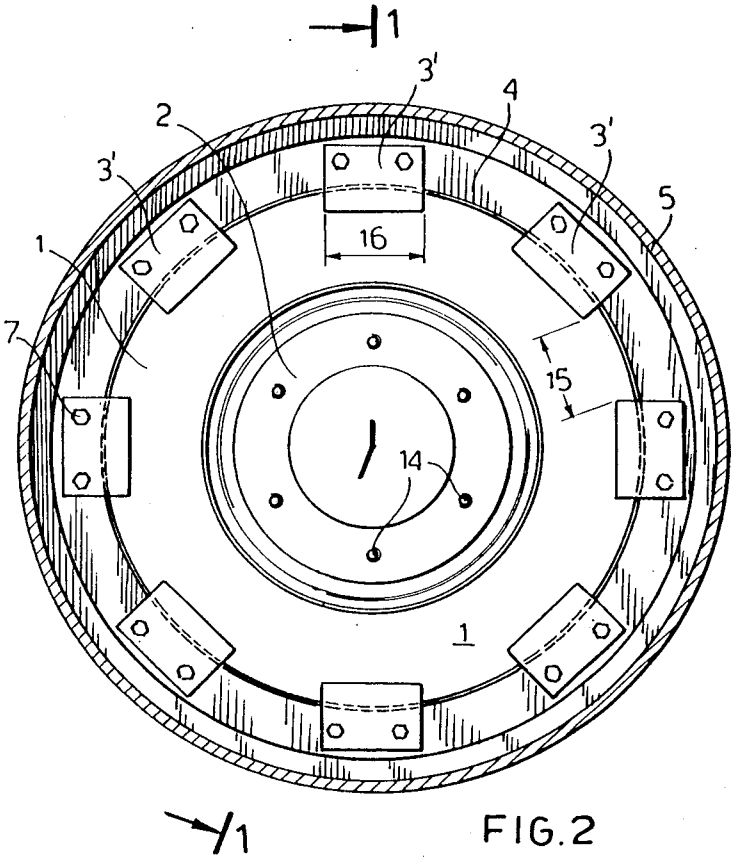
FIG. 2 is a sectional view along A—A of FIG. 1, showing the vibrating drum, the pneumatic ring and some parts of the general frame of the machine.

To this end the rigid elements 3 and 3', as shown by the sectional views in FIGS. 1 and 2, have the shape of an "S", which allows the pneumatic ring 1 to be enveloped and gripped by the combined action of the rigid elements. The outer rigid elements 3, 3' are arranged to be spaced apart along the outer circumference of the pneumatic ring 1 (FIG. 1). From past experience it is known that the spacing of the elements 3 and 3' along the outer circumference is very important for the correct functioning and long life of the suspension. This distance 15 (FIG. 2) is also a function of the length of the surface 16 of elements 3 and 3' which engages with the outer wall of the pneumatic ring 1.

For the sake of simplicity the distance 15 and the length of the surface 16 are expressed conventionally using a simple linear measurement, with the supposition that said measurement is made along the outer circumference of the pneumatic ring 1.

With R indicating the outer radius of the toroidal pneumatic ring 1, according to the present invention the following geometric conditions are to be complied with:

$$\left(R \cdot \frac{\pi}{2}\right) > l > R\frac{\pi}{8}$$

where l=length of surface 16 that is, every rigid element 3 and 3' must have a length of surface (16) measured along the circumference, which is no greater than one quarter of the outer circumference of the pneumatic ring 1, but no shorter than one sixteenth thereof.

The distance 15 along the circumference between two adjacent outer rigid elements must be within one half and one and a half times the length 16 along the circumference of each element 3 and 3'.

What I claim is:

1. A fully pneumatic suspension for a vibrating tamping machine comprising: at least one toroid-shaped pneumatic ring having a central rotational axis; rim-shaped inner rigid elements engaged with said ring; and pairs of outer elements, wherein said inner elements are connected with a part of the machine which must be kept free from vibration and said pairs of outer elements are connected with a part of the machine intended to vibrate, and wherein said outer elements, once fixed in position, form a polygonal structure in direct contact with the pneumatic ring, said polygonal structure comprising pairs of outer elements disposed symmetrically on two sides of the pneumatic ring relative to a plane passing transverse to said axis and between said pairs of outer elements and which grip said ring when fixed in position.

2. A fully pneumatic suspension for vibrating tamping machine according to claim 1, wherein the elements gripping the pneumatic ring are S-shaped so as to be able to grip said pneumatic ring during a fixing operation.

3. A fully pneumatic suspension as in claim 1, wherein said part of the machine intended to vibrate is a drum.

4. A fully pneumatic suspension for a vibrating tamping machine according to claim 1, wherein the length of an arc subtended by each pair of outer elements along an outer circumference of said pneumatic ring is greater than 1/16 of the outer circumference of the ring but less than ¼ of the outer circumference of the ring.

5. A fully pneumatic suspension for a vibrating tamping machine according to claim 1, wherein the length of an arc subtended along the outer circumference of said ring between two adjacent pairs of said outer elements is greater than one half of the length of the arc subtended along said outer circumference by each pair of outer elements and less than one and one half of that length.

6. A fully pneumatic suspension for a vibrating tamping machine according to claim 5, wherein said length along said circumference of said pneumtic ring subtended by said outer elements is greater than 1/16 of the outer circumference of the ring but less than ¼ of the outer circumference of the ring.

* * * * *